US008261471B2

(12) United States Patent
Hall et al.

(10) Patent No.: US 8,261,471 B2
(45) Date of Patent: Sep. 11, 2012

(54) CONTINUOUSLY ADJUSTING RESULTANT FORCE IN AN EXCAVATING ASSEMBLY

(76) Inventors: David R. Hall, Provo, UT (US); Ronald B. Crockett, Payson, UT (US); Thomas Morris, Spanish Fork, UT (US)

( * ) Notice: Subject to any disclaimer, the term of this patent is extended or adjusted under 35 U.S.C. 154(b) by 205 days.

(21) Appl. No.: 12/828,273

(22) Filed: Jun. 30, 2010

(65) Prior Publication Data

US 2012/0000097 A1 Jan. 5, 2012

(51) Int. Cl.
*E02F 1/00* (2006.01)

(52) U.S. Cl. ..... 37/195; 299/104

(58) Field of Classification Search ..... 37/195, 37/466, 348, 460; 299/1.05, 1.2, 1.4, 1.1, 299/104–107; 73/7, 104; 173/122, 152, 173/171; 405/263, 267, 269, 241, 233, 239, 405/48, 93

See application file for complete search history.

(56) References Cited

U.S. PATENT DOCUMENTS

| | | | | | |
|---|---|---|---|---|---|
| 2,124,438 | A | | 7/1938 | Struk | |
| 3,015,477 | A | * | 1/1962 | Persson et al. | 299/1.2 |
| 3,254,392 | A | | 6/1966 | Novkov | |
| 3,550,959 | A | * | 12/1970 | Alford | 299/1.2 |
| 3,746,396 | A | | 7/1973 | Radd | |
| 3,830,321 | A | | 8/1974 | McKenry | |
| 4,001,798 | A | * | 1/1977 | Robinson | 340/870.18 |
| 4,098,362 | A | | 7/1978 | Bonnice | |
| 4,109,737 | A | | 8/1978 | Bovenkerk | |
| 4,156,329 | A | | 5/1979 | Daniels | |
| 4,199,035 | A | | 4/1980 | Thompson | |
| 4,322,113 | A | * | 3/1982 | Taylor et al. | 299/1.4 |
| 4,439,250 | A | | 3/1984 | Acharya | |
| 4,445,578 | A | | 5/1984 | Millheim | |
| 4,465,221 | A | | 8/1984 | Schmidt | |
| 4,660,890 | A | | 4/1987 | Mills | |
| 4,725,098 | A | | 2/1988 | Beach | |
| 4,728,153 | A | | 3/1988 | Ojanen | |
| 4,776,862 | A | | 10/1988 | Wiand | |
| 4,836,614 | A | | 6/1989 | Ojanen | |
| 4,850,649 | A | | 7/1989 | Beach | |
| 4,880,154 | A | | 11/1989 | Tank | |
| 4,921,310 | A | | 5/1990 | Hedlund | |
| 4,932,723 | A | | 6/1990 | Mills | |
| 4,940,288 | A | | 7/1990 | Stiffler | |
| 4,951,762 | A | | 8/1990 | Lundell | |
| 5,092,657 | A | * | 3/1992 | Bryan, Jr. | 299/1.1 |
| 5,112,165 | A | | 5/1992 | Hedlund | |
| 5,141,289 | A | | 8/1992 | Stiffler | |
| 5,186,892 | A | | 2/1993 | Pope | |
| 5,205,612 | A | * | 4/1993 | Sugden et al. | 299/10 |
| 5,358,059 | A | | 10/1994 | Ho | |
| 5,415,462 | A | | 5/1995 | Massa | |
| 5,438,860 | A | * | 8/1995 | Kawai et al. | 73/7 |
| 5,503,463 | A | | 4/1996 | Ojanen | |
| 5,725,283 | A | | 3/1998 | O'Neill | |
| 5,730,502 | A | | 3/1998 | Montgemery | |

(Continued)

*Primary Examiner* — Robert Pezzuto
(74) *Attorney, Agent, or Firm* — Philip W. Townsend, III

(57) ABSTRACT

In one aspect of the present invention, a method of excavation with pointed cutting elements, comprising the steps of providing a excavating assembly with at least one pointed cutting element, the pointed cutting element comprising a rounded apex that intersects a central axis, the pointed cutting element further has a characteristic of having its highest impact resistance to resultant forces aligned with the central axis; engaging the at least one pointed cutting element against a formation such that the formation applies a resultant force against the pointed cutting element; determining an angle of the resultant force; and modifying at least one excavating parameter to align the resultant force with the pointed cutting element's central axis.

18 Claims, 12 Drawing Sheets

U.S. PATENT DOCUMENTS

| | | | |
|---|---|---|---|
| 5,738,698 | A | 4/1998 | Kapoor |
| 5,823,632 | A | 10/1998 | Burkett |
| 5,837,071 | A | 11/1998 | Anderson |
| 5,934,542 | A | 8/1999 | Nakamura |
| 5,935,718 | A | 8/1999 | Demo |
| 5,944,129 | A | 8/1999 | Jenson |
| 6,051,079 | A | 4/2000 | Andersson |
| 6,065,552 | A | 5/2000 | Scott |
| 6,116,819 | A | 9/2000 | England |
| 6,193,770 | B1 | 2/2001 | Sung |
| 6,196,636 | B1 | 3/2001 | Mills |
| 6,199,956 | B1 | 3/2001 | Kammerer |
| 6,357,832 | B1 | 3/2002 | Sollami |
| 6,508,516 | B1 | 1/2003 | Kammerer |
| 6,644,755 | B1 | 11/2003 | Kammerer |
| 6,692,083 | B2 | 2/2004 | Latham |
| 6,786,557 | B2 | 9/2004 | Montgomery, Jr. |
| 6,824,225 | B2 | 11/2004 | Stiffler |
| 6,851,758 | B2 | 2/2005 | Beach |
| 6,854,810 | B2 | 2/2005 | Montgomery |
| 6,861,137 | B2 | 3/2005 | Griffin et al. |
| 6,889,890 | B2 | 5/2005 | Yamazaki |
| 6,962,395 | B2 | 11/2005 | Mouthaan |
| 7,014,271 | B2 * | 3/2006 | Burger et al. ..... 299/1.05 |
| 2002/0070602 | A1 | 6/2002 | Sollami |
| 2002/0175555 | A1 | 11/2002 | Mercier |
| 2003/0137185 | A1 | 7/2003 | Sollami |
| 2003/0141350 | A1 | 7/2003 | Noro |
| 2003/0141753 | A1 | 7/2003 | Peay |
| 2003/0230926 | A1 | 12/2003 | Mondy |
| 2003/0234280 | A1 | 12/2003 | Cadden |
| 2005/0159840 | A1 | 7/2005 | Lin |
| 2005/0173966 | A1 | 8/2005 | Mouthaan |
| 2006/0125306 | A1 | 6/2006 | Sollami |

* cited by examiner

CONTINUOUSLY ADJUSTING RESULTANT FORCE IN AN EXCAVATING ASSEMBLY

BACKGROUND OF THE INVENTION

The present invention relates to an adjustment mechanism for adjusting force vectors in excavating natural and man-made formations, including downhole drilling, trenching, mining, and road milling. More specifically, the present invention relates to adjusting a resultant force vector acting on a cutting element in an excavating assembly. The magnitude and direction of resultant force vector depends on a plurality of excavating parameters.

U.S. Pat. No. 6,116,819 to England, which is herein incorporated by reference for all that it contains, discloses a method of continuous flight auger piling and a continuous flight auger rig, wherein an auger is applied to the ground so as to undergo a first, penetration phase and a second, withdrawal phase, and wherein the rotational speed of and/or the rate of penetration of and/or the torque applied to the auger during the first, penetration phase are determined and controlled as a function of the ground conditions and the auger geometry by means of an electronic computer so as to tend to keep the auger flights loaded with soil originating from the region of the tip of the auger. During the withdrawal phase, concrete may be supplied to the tip of the auger by way of flow control and measuring means, the rate of withdrawal of the auger being controlled as a function of the flow rate of the concrete, or vice-versa, by means of an electronic computer so as to ensure that sufficient concrete is supplied to keep at least the tip of the auger immersed in concrete during withdrawal.

U.S. Pat. No. 5,358,059 to Ho, which is herein incorporated by reference for all that it contains, discloses an apparatus and method for use in determining drilling conditions in a borehole in the earth having a drill string, a drill bit connected to an end of the drill string, sensors positioned in a cross-section of the drill string axially spaced from the drill bit, and a processor interactive with the sensors so as to produce a humanly perceivable indication of a rotating and whirling motion of the drill string. The sensors serve to carry out kinematic measurements and force resultant measurements of the drill string. The sensors are a plurality of accelerometers positioned at the cross-section. The sensors can also include a plurality of orthogonally-oriented triplets of magnetometers. A second group of sensors is positioned in spaced relationship to the first group of sensors along the drill string. The second group of sensors is interactive with the first group of sensors so as to infer a tilting of an axis of the drill string.

U.S. Pat. No. 4,445,578 to Millheim, which is herein incorporated by reference for all that it contains, discloses an apparatus for measuring the side force on a drill bit during drilling operations and transmitted to the surface where it can be used in predicting trajectory of the hole and taking corrective action in the drilling operation. A downhole assembly using a downhole motor is modified to include means to detect the side thrust or force on a bit driven by the motor and the force on the deflection means of the downhole motor. These measured forces are transmitted to the surface of the earth during drilling operations and are used in evaluating and controlling drilling operations. Means are also provided to measure magnitude of the force on a downhole stabilizer.

BRIEF SUMMARY OF THE INVENTION

In one aspect of the present invention, a method of excavation with pointed cutting elements, comprising the steps of providing a excavating assembly with at least one pointed cutting element, the pointed cutting element comprising a rounded apex that intersects a central axis, the pointed cutting element further has a characteristic of having its highest impact resistance to resultant forces aligned with the central axis; engaging the at least one pointed cutting element against a formation such that the formation applies a resultant force against the pointed cutting element; determining an angle of the resultant force; and modifying at least one excavating parameter to align the resultant force with the pointed cutting element's central axis.

The excavating assembly may comprise comprises at least one transducer. At least one force measured by the first and second transducer may be modified to align the resultant force with the pointed cutting element's central axis. At least one excavating parameter may be a torque force acting laterally on the cutting element. At least one excavating parameter may be weight loaded to each cutting element. The pointed cutting elements may comprise a wear resistant tip comprising a superhard material bonded to a cemented metal carbide.

The method of excavating may comprise the step of determining an ideal torque, ideal rotational velocity, and/or ideal weight available to drive the excavating assembly. The method may further comprise the step of increasing or decreasing weight loaded to each cutting element to align the resultant force with the central axis of the cutting element. The method may further comprise the step of increasing or decreasing rotational velocity to align the resultant force with the central axis of the cutting element.

The excavating assembly may be an auger assembly, a milling machine, a trenching machine, an excavator, or combinations thereof. A method of determining the angle of the resultant force may comprise a plurality of measurement mechanism positioned inside the cutting elements. A magnitude and direction of the weight loaded to each cutter, and torque acting on each cutter may be measured. The measured data may be transferred to an excavating control mechanism. The measurement mechanism may comprise a strain gauge mounted on a pre-tensioned strain bolt, a button load cell, or combination thereof. The measuring mechanism may be oriented in three different orthogonal directions. The excavating control mechanism may continuously modify the excavating parameters to align the resultant force with the pointed cutting element's central axis regardless of ground condition. In embodiments, where the excavating assembly, comprises a drill bit with blade, at least one blade may comprise a measuring mechanism positioned in its thickness.

FIG. **6*a*** is a cross-sectional diagram of another embodiment of a pointed cutting element.

FIG. **6*b*** is an orthogonal diagram of an embodiment of a cutter arrangement of an auger head assembly.

Figure 7:
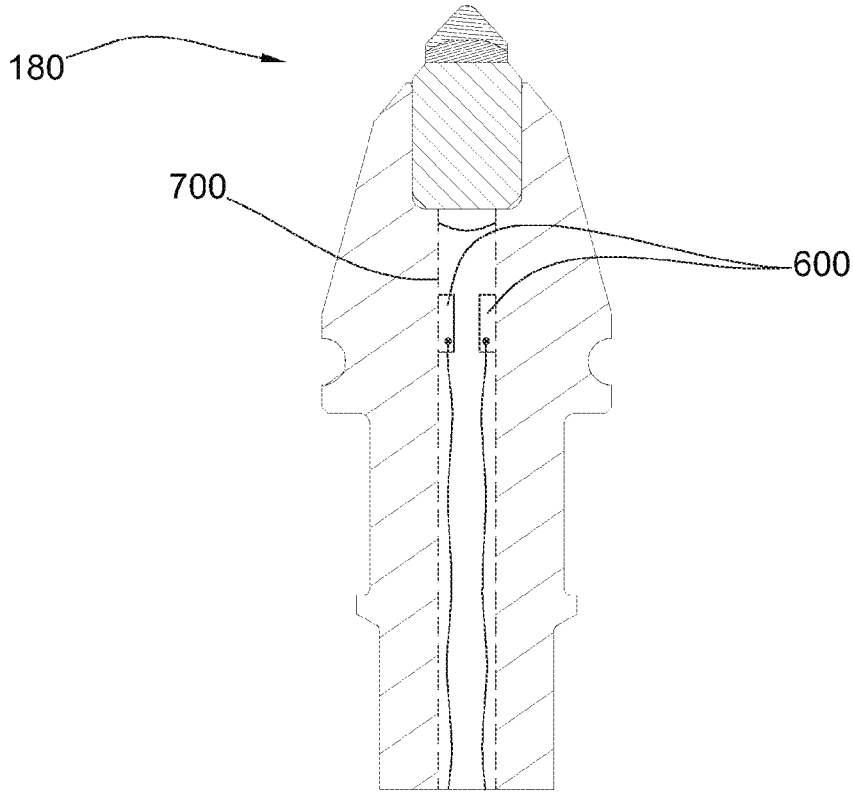

FIG. 7 is a cross-sectional diagram of another embodiment of a pointed cutting element.

Figure 8:
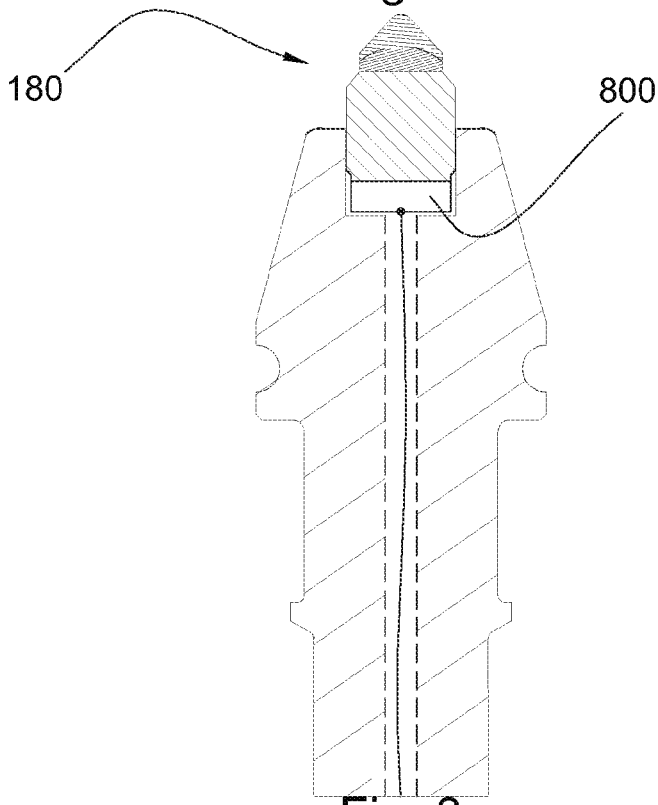

FIG. 8 is a cross-sectional diagram of another embodiment of a pointed cutting element.

Figure 9:
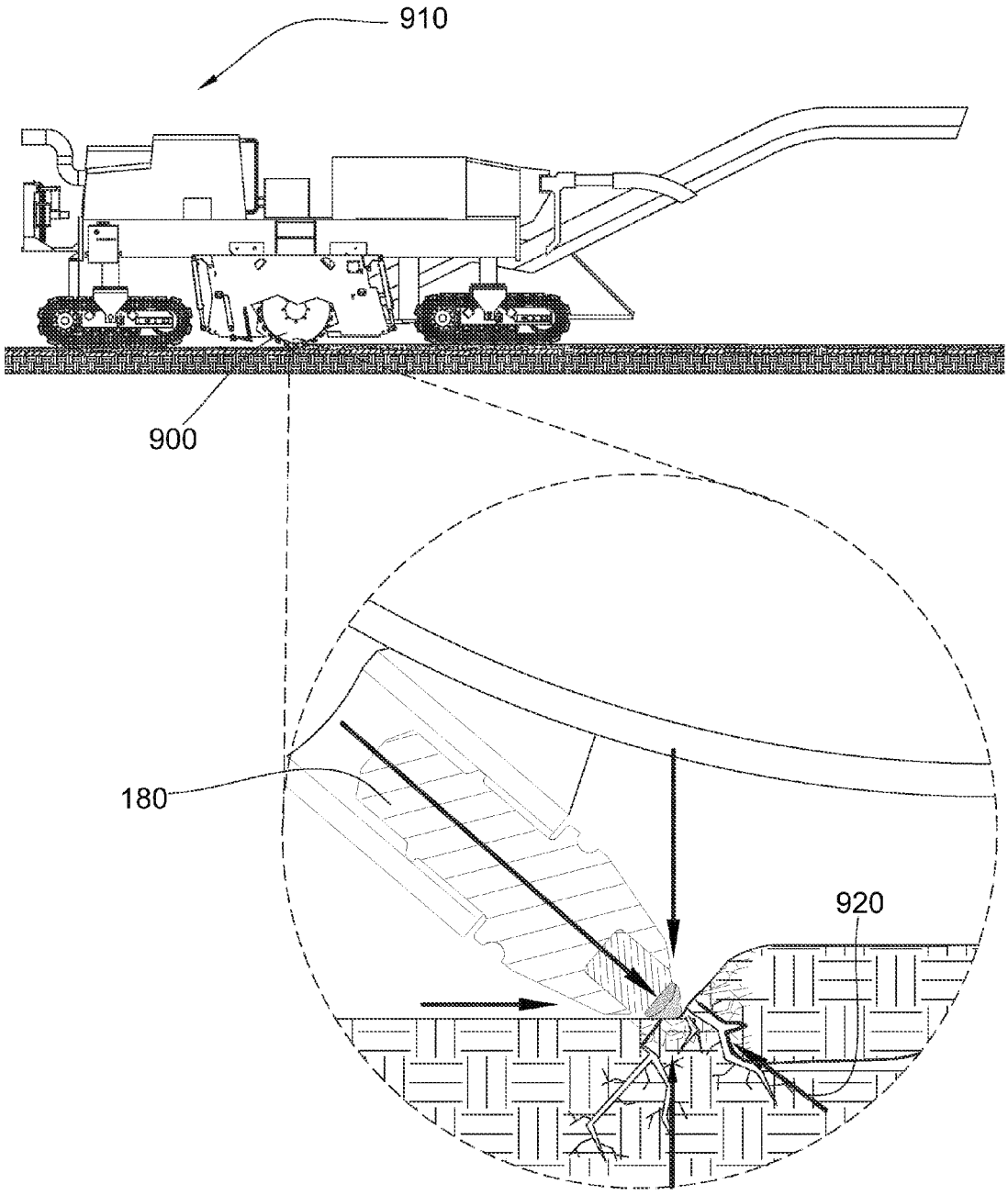

FIG. 9 is a cross-sectional diagram of another embodiment of a pointed cutting element on a rotating drum.

Figure 10:
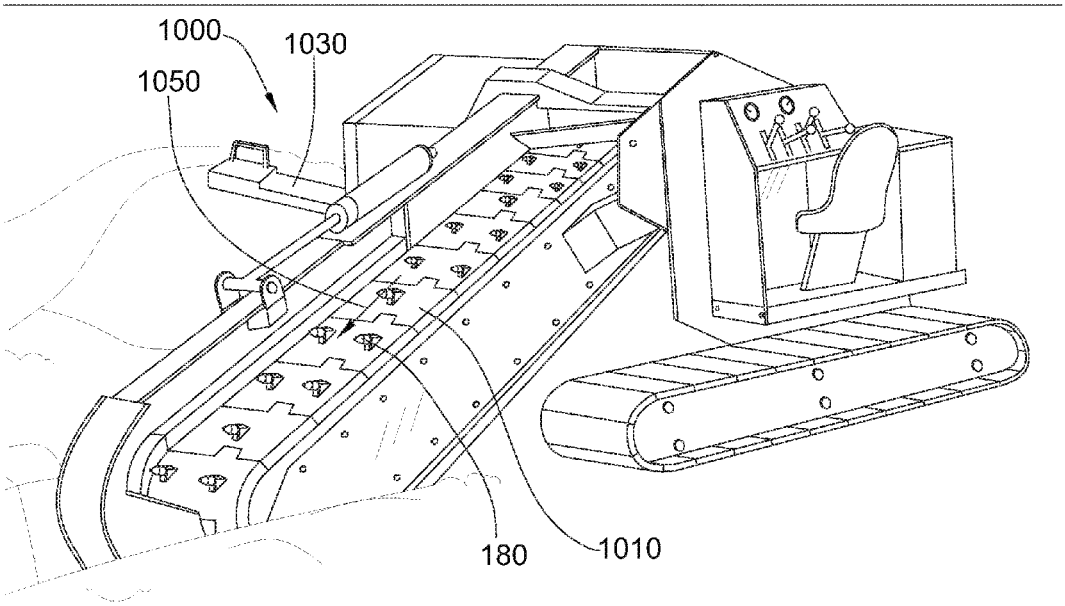

FIG. 10 is a perspective diagram of an embodiment of a trenching machine.

Figure 11A:
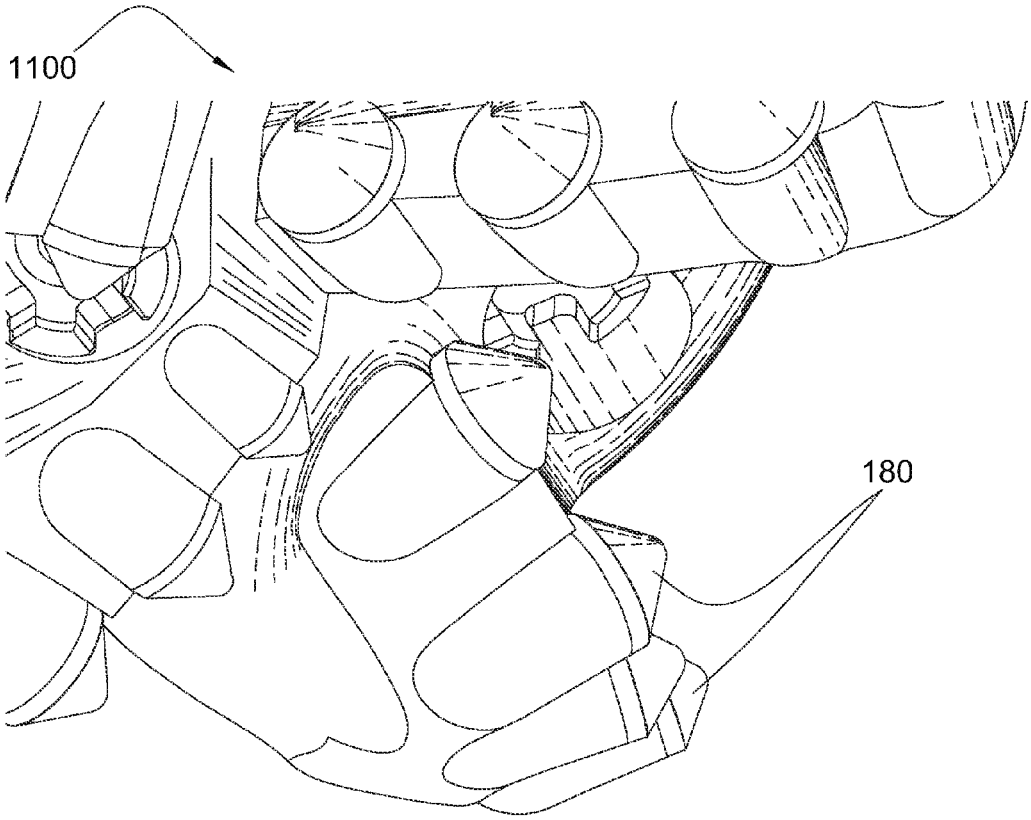

FIG. 11*a* is a perspective diagram of an embodiment of a drill bit.

Figure 11B:
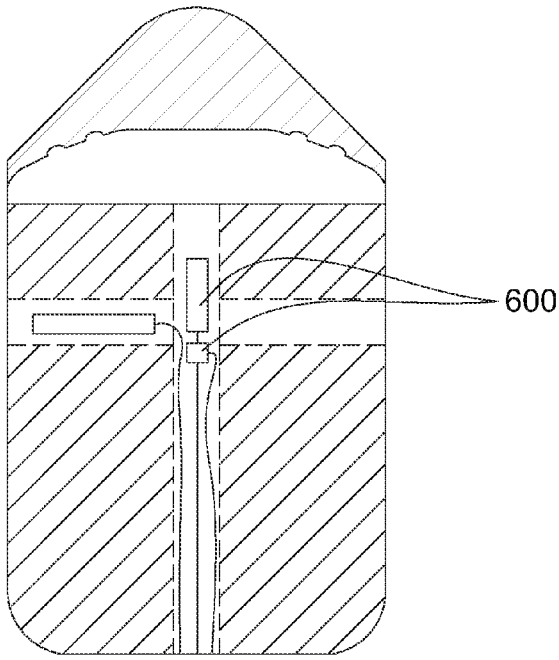

FIG. 11*b* is a cross-sectional diagram of another embodiment of a pointed cutting element.

Figure 12A:
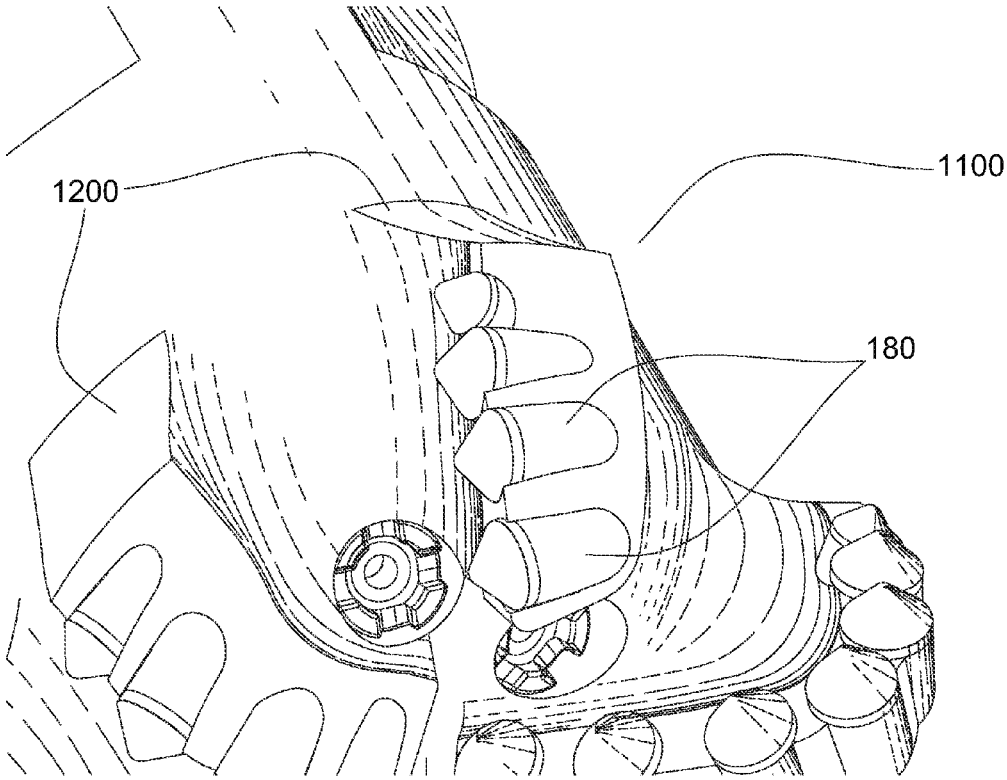

FIG. 12*a* is a perspective diagram of another embodiment of a drill bit.

Figure 12B:
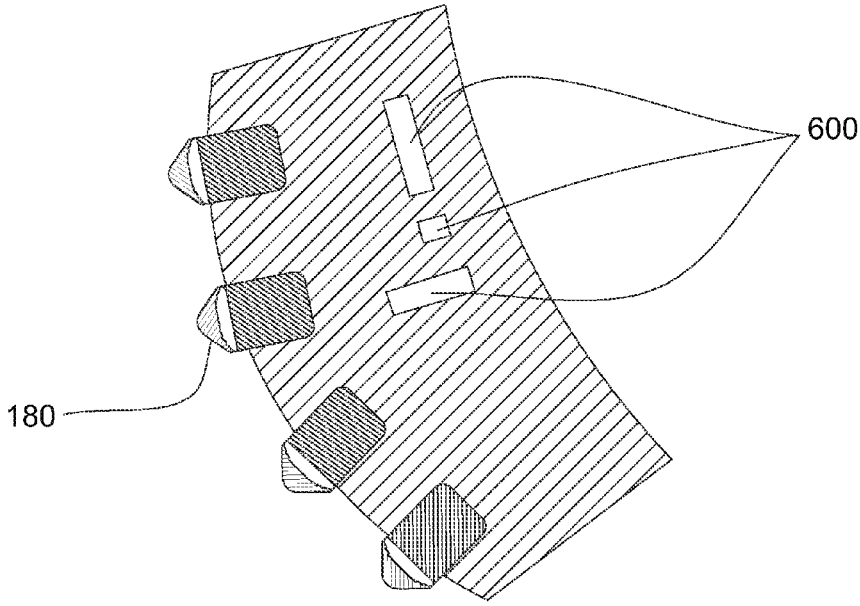

FIG. 12*b* is a cross-sectional diagram of an embodiment of a blade of a drill bit.

Figure 13:
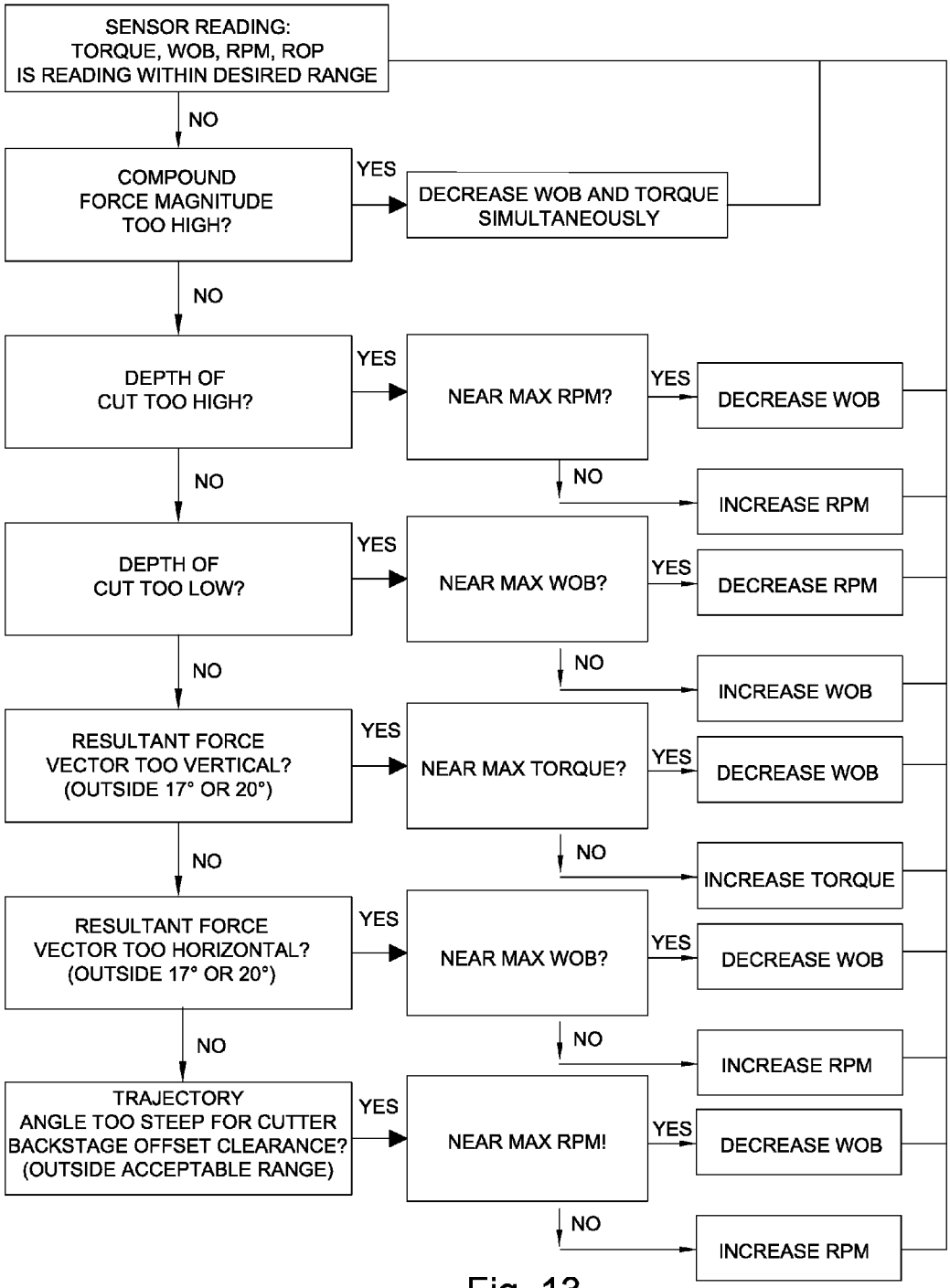

FIG. 13 is a schematic diagram of an embodiment of a drilling method.

DETAILED DESCRIPTION OF THE INVENTION AND THE PREFERRED EMBODIMENT

Figure 1:
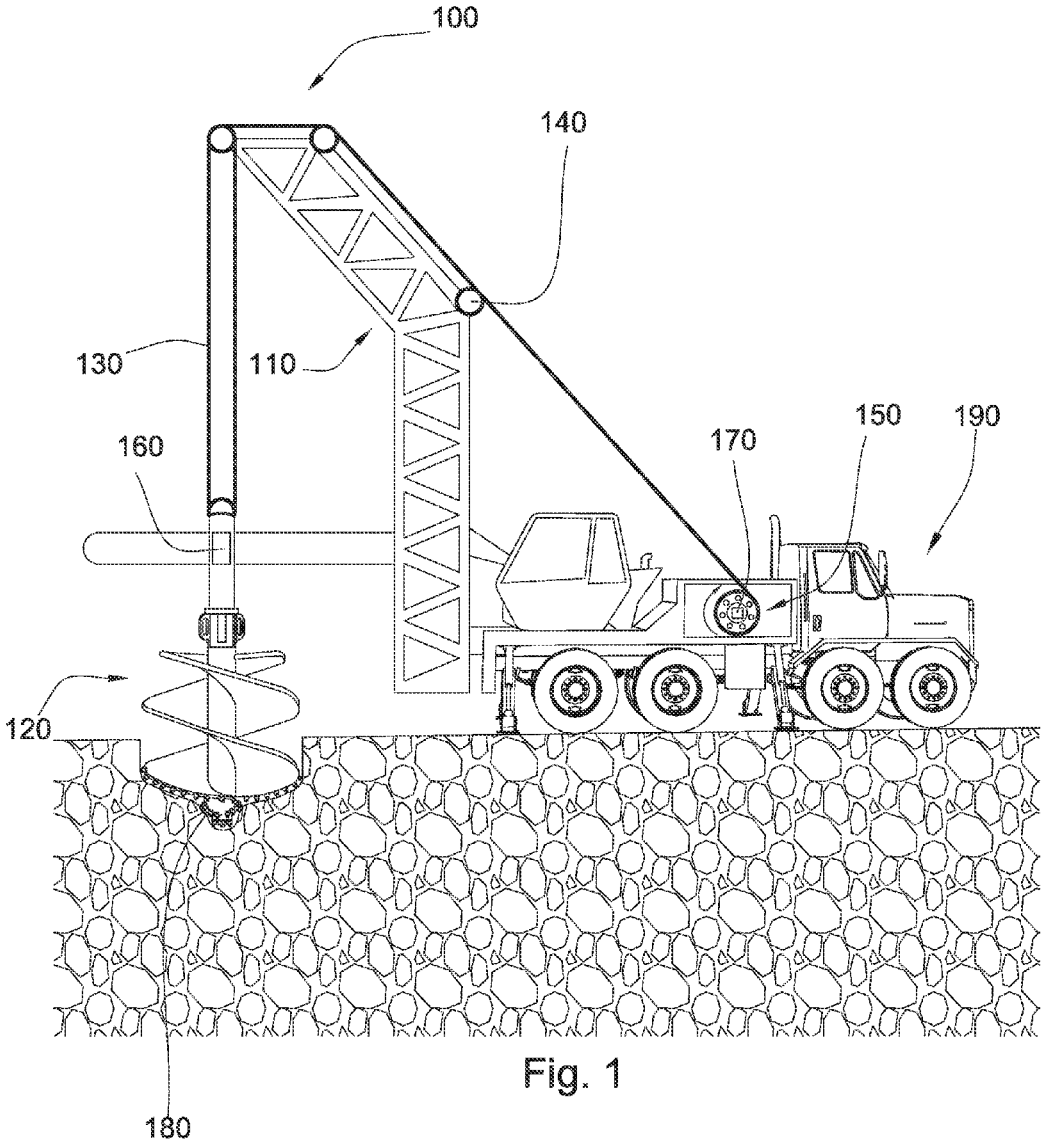
FIG. 1 is a perspective diagram of an embodiment of a drilling assembly.

FIG. 1 is a perspective diagram of an embodiment of a drilling rig 100 comprising an auger assembly 120 suspended from a drilling mast 110 on a drill string 130. The drilling rig 100 may comprise a plurality of pulleys 140 over which a suspension cable 130 passes. The suspension cable 130 may be wound up on a rotating wheel 150 positioned on the back of a truck 190 with equal length on each turning. The auger assembly 120 may be lowered down or pulled up by utilizing the rotating wheel 150 and the pulley mechanism 140. A first torque transducer 160 may be positioned at the end of a shaft of the auger assembly 120 and a second torque transducer 170 may be positioned at the end of a shaft of the rotating wheel 150. The first torque transducer 160 may measure the torque applied to each pointed cutting element 180 in the auger assembly 120. The second torque transducer 170 may measure weight loaded to each pointed cutting element 180.

The method of measuring the weight loaded to each cutting element 180 may comprise the step of measuring the torque applied to the rotating wheel 150 in the direction of rotation. The weight loaded to the cutting elements 180 may be calculated by using the formula:

Weight on bit(WOB)=(weight of the auger assembly 120)−(tangential force on the wheel 150×radius of the wheel 150)

The weight of the auger assembly 120 and the radius of the wheel 150 are fixed; thus, the changing the tangential force on the wheel is the primary mechanism for modifying WOB.

Figure 2:
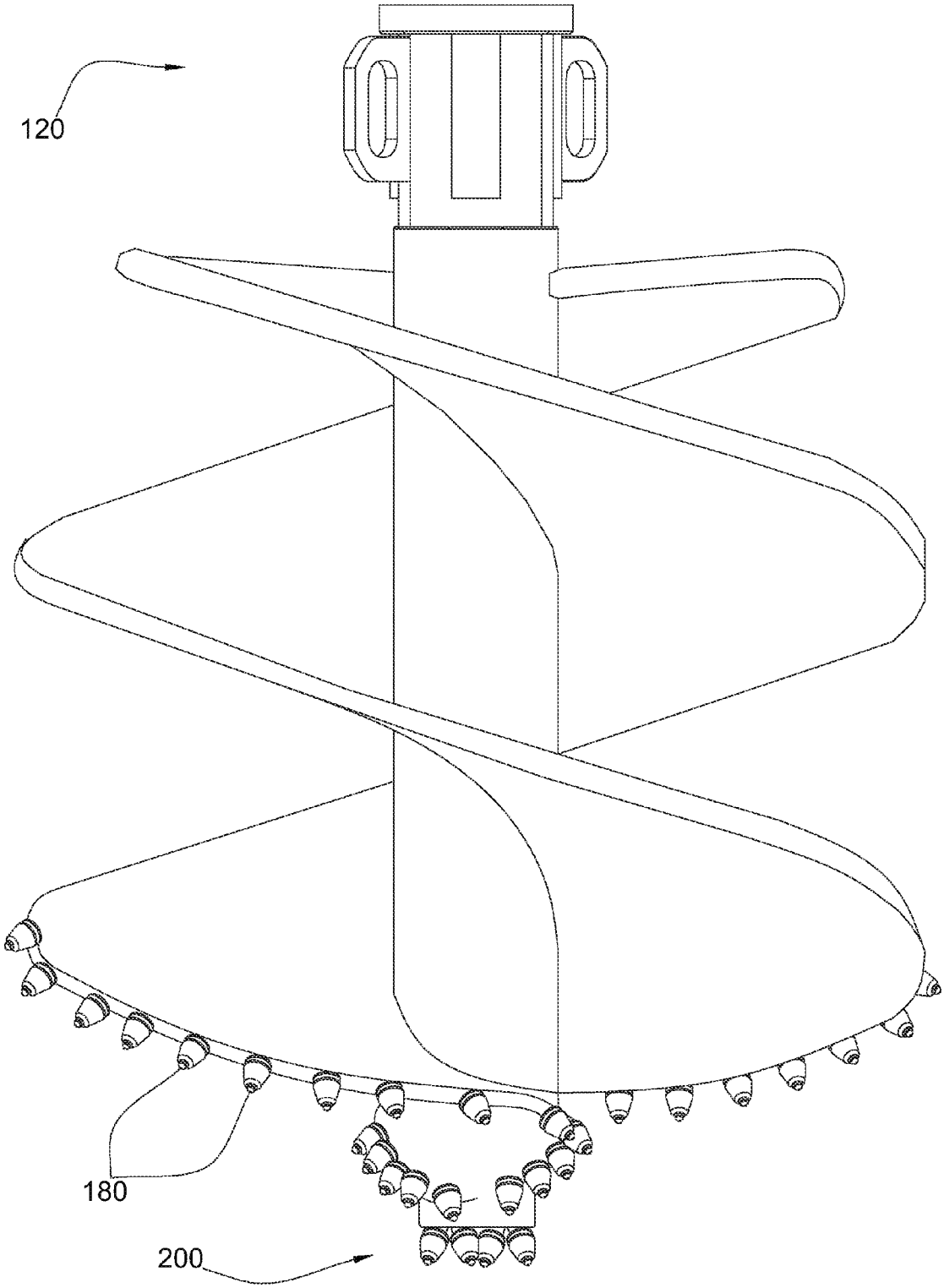
FIG. 2 is a perspective diagram of an embodiment of an auger assembly.

FIG. 2 discloses the auger assembly 120 comprising a plurality of pointed cutting elements 180. The pointed cutting elements 180 may comprise a wear resistant tip comprising a superhard material bonded to a cemented metal carbide substrate. The super hard material may comprise a material selected from a group comprising diamond, sintered polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

Figure 3:
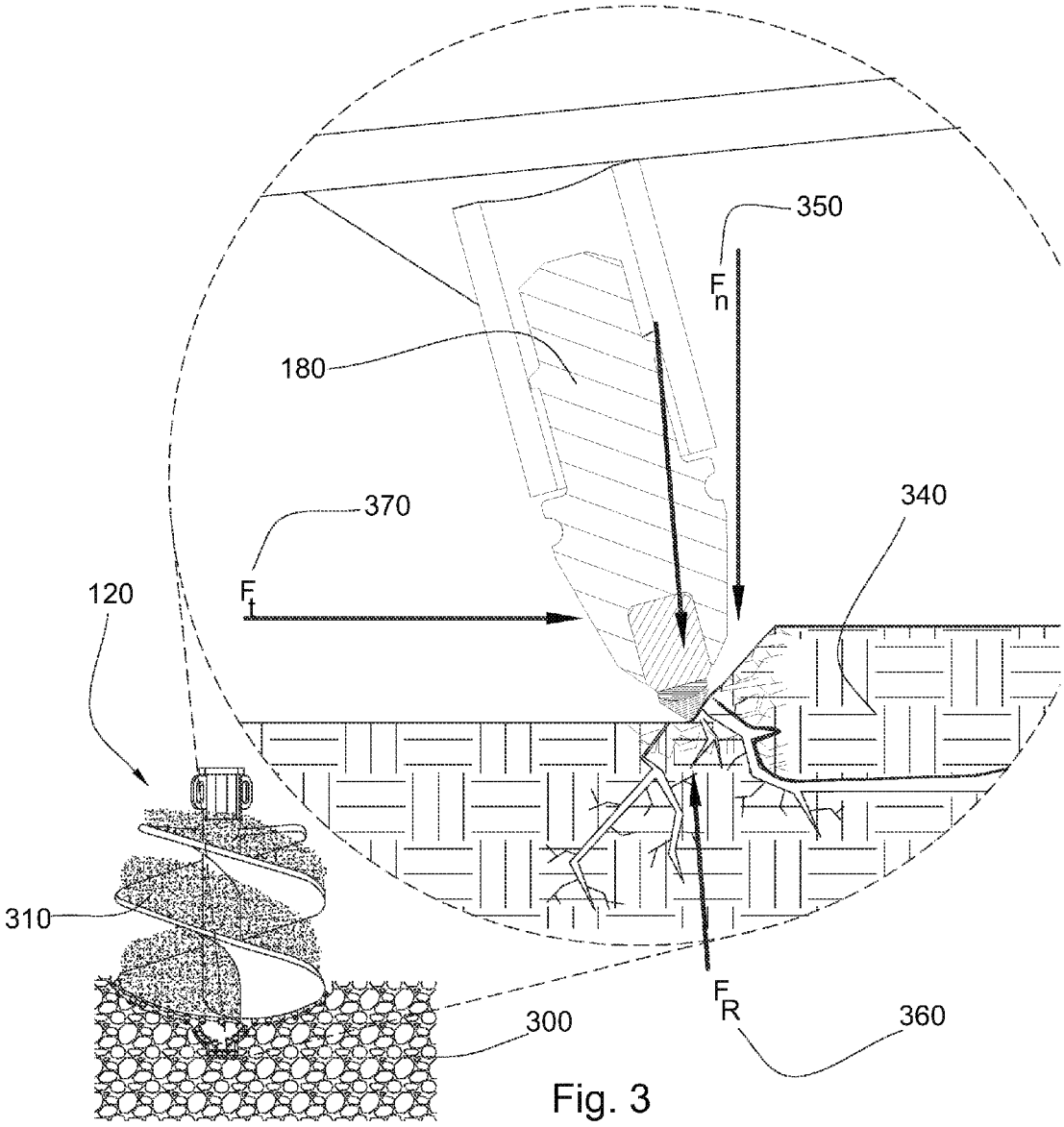
FIG. 3 is a cross-sectional diagram of an embodiment of a pointed cutting element.

FIG. 3 discloses the auger assembly 120 in contact with a formation 300. The pointed cutting element 180 may cut through the formation 300, thereby removing dirt and debris out of the formation via blades 310 of the auger assembly 120. The cutting element 180 may experience a plurality of forces. The cutting element 180 may experience a normal force 350 acting substantially perpendicular to the tip of the cutting element 180 from the weight of the excavator assembly. The cutting element 180 may also experience torque 370 that loads the element from the side. The combination of these forces may be considered a vector force. The formation loads the formation in an equal and opposite manner, resulting in a resultant vector force loaded to the pointed cutting element.

When the vector force does not align with the central axis of the cutting element, then the resultant vector forces do not either. Since the cutting element is pointed, the non-aligned forces may load the cutting element in a way that the cutting element in a direction that the cutting element is weak. For example, a pointed cutting element does not have a large cross section at its apex, so a load that transverses the apex meets little resistance from the apex's cross section. On the other hand, when the load is substantially aligned with the central axis of the cutter, the entire length of the cutting element may buttress the apex again the load.

The resultant force 360 may vary depending on a number of excavating parameters such as weight loaded to each cutting element, torque, rotational velocity, rate of penetration and type of formation.

The excavating parameters may be modified to substantially align the resultant force 360 with the pointed cutting element's central axis. The pointed cutting element 180 is believed to have the characteristic of having its highest impact resistance along its central axis. At least one excavating parameter may be modified to align the resultant force 360 with the pointed cutting element's central axis. The electronic means may continuously modify the excavating parameters to align the resultant force 360 with the pointed cutting element's central axis regardless of formation 300 conditions.

For purposes of this disclosure, an aligned resultant force is within + or − ten degrees of the axis in some embodiments. In other embodiments, substantially aligning may be within five degrees. Preferably, an aligned resultant force is within 2 degrees.

Figure 4:
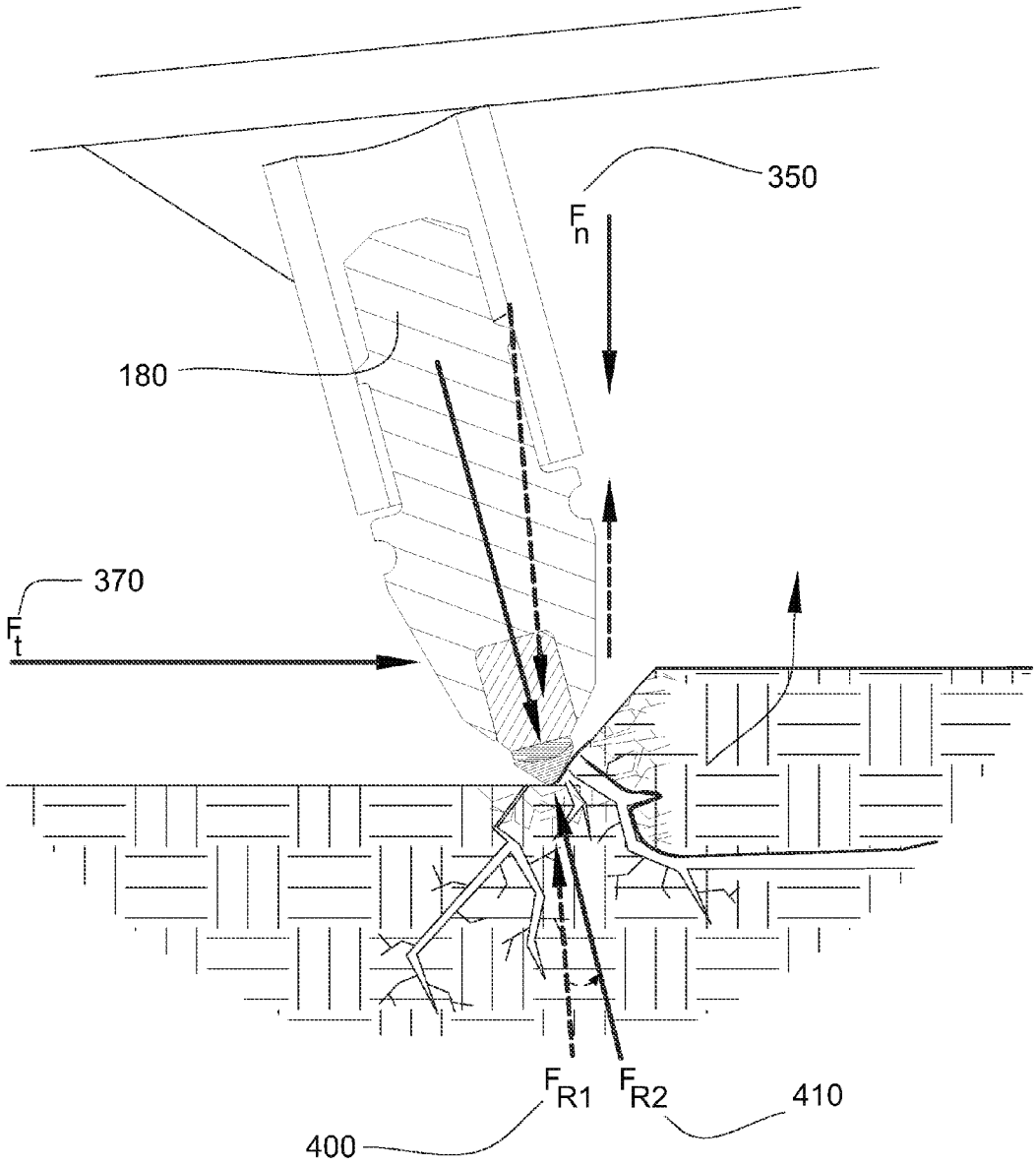
FIG. 4 is a cross-sectional diagram of another embodiment of a pointed cutting element.

FIG. 4 discloses a method of modifying at least one excavating parameter to align the resultant force with the pointed cutting element's central axis. For instances, the weight loaded to each cutting element 180 may be too high. In such cases, the resultant force 400 may misalign vertically. To adjust the resultant force, the weight loaded to each cutting element 180 may be decreased to shift the vector force to substantially align with the cutting element's axis. By shifting the vector force, the resultant force 410 also realigned along the central axis.

Figure 5:
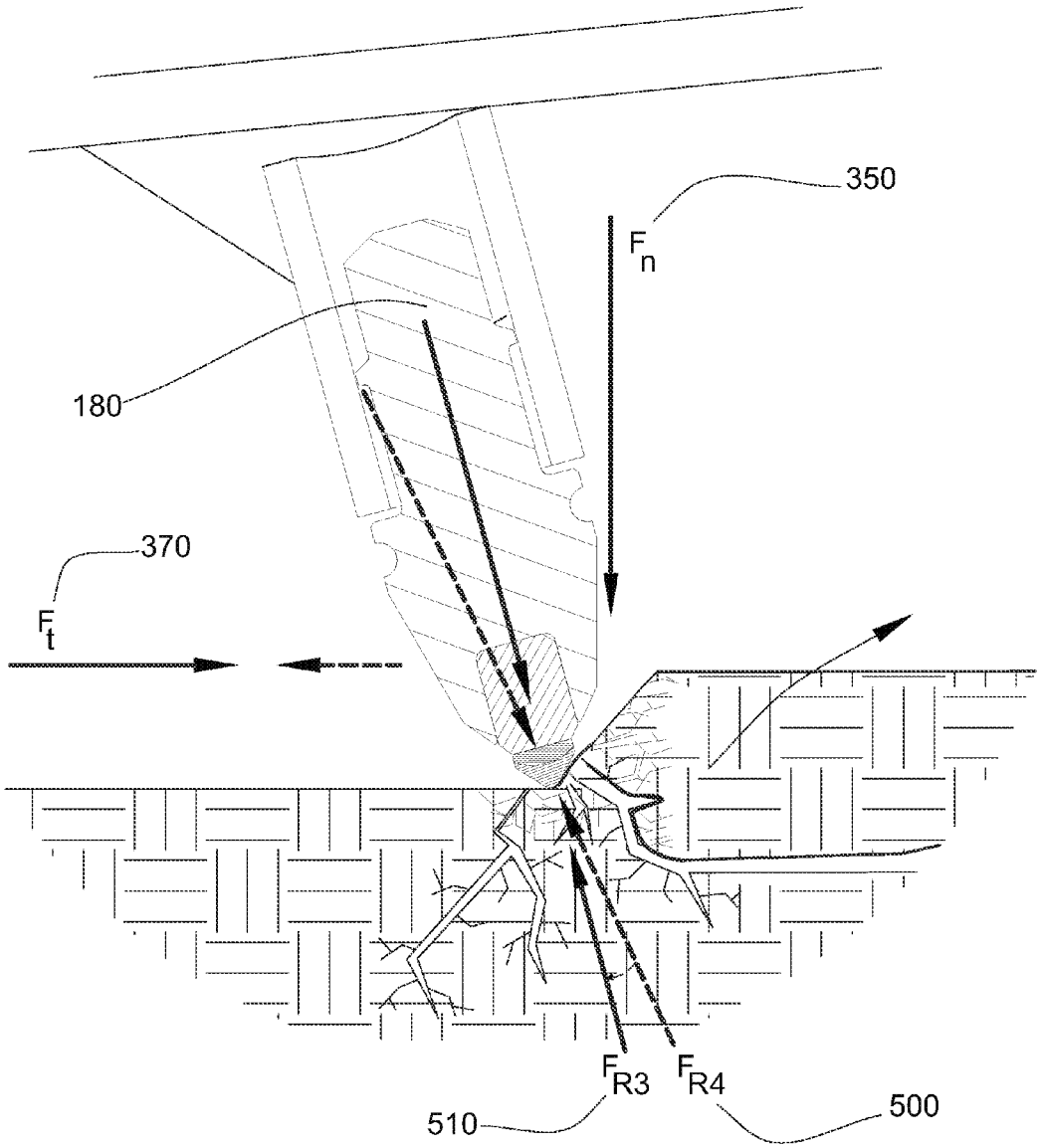
FIG. 5 is a cross-sectional diagram of another embodiment of a pointed cutting element.

Referring to FIG. 5, the torque 370 may be too high causing the cutting element to be side loaded. The torque 370 may be decreased to align the resultant force 510 with the pointed cutting element's central axis as illustrated by the solid arrows. In some embodiments, both torque 370 and weight loaded to each cutting element 180 may be modified to align the resultant force with the pointed cutting element's central axis.

Frequently, natural and man-made formations vary in hardness and composition. As the formation's characteristics vary, so may the resultant force angles and strengths. For example, as a drill bit transitions between a soft and a hard formation, the stresses on the cutting elements may change, resulting in a change in the excavating parameters to keep the resultant forces substantially aligned with the element's central axis.

Figure 6A:
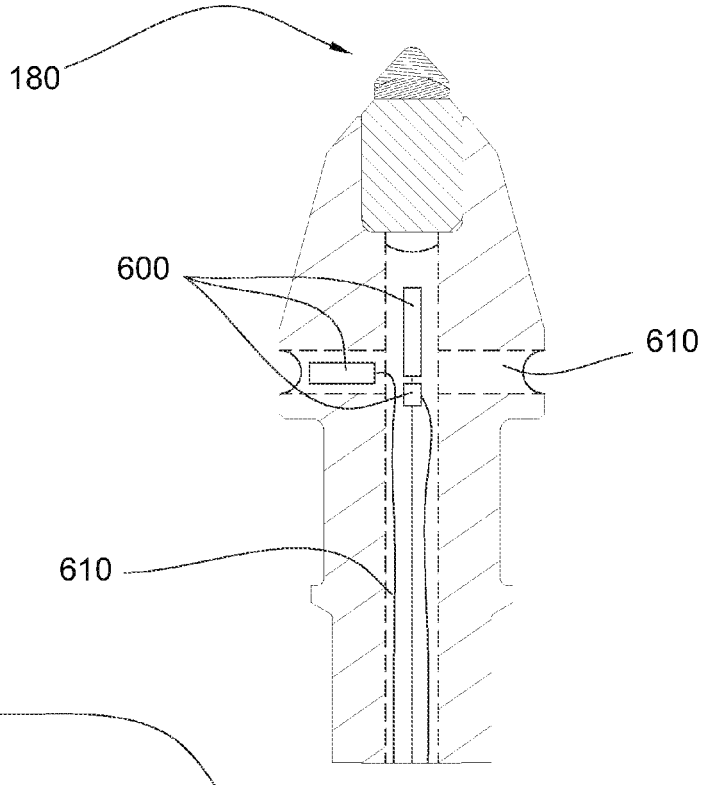

Referring to FIG. 6*a*, a cross-sectional diagram of an embodiment of a pointed cutting element 180 is disclosed.

The pointed cutting element 180 may comprise a plurality of measuring mechanisms such as strain gauges 600 positioned inside a pick. The strain gauges 600 may be mounted on a pre-tensioned strain bolt. Such an arrangement is believed to measure both compression and tension acting on the cutting element 180 more precisely. The cutting element 180 may comprise small diameter bore holes 610. One bore hole may extend from the forward end of the cutting element 180 to a distal end of the cutting element 180. Another bore hole may extend laterally such that the two bore holes interfere perpendicularly. The bore holes 610 are made such that strength of the cutting element remains unaffected. The strain bolts with strain gauges 600 may be placed inside the body of cutting element 180 via bore holes 610. The strain gauges 600 may be positioned in three different axes of rotation that are substantially perpendicular to each other. The strain gauges 600 may measure the axial forces acting on the cutting element 180 in such a configuration.

Figure 6B:
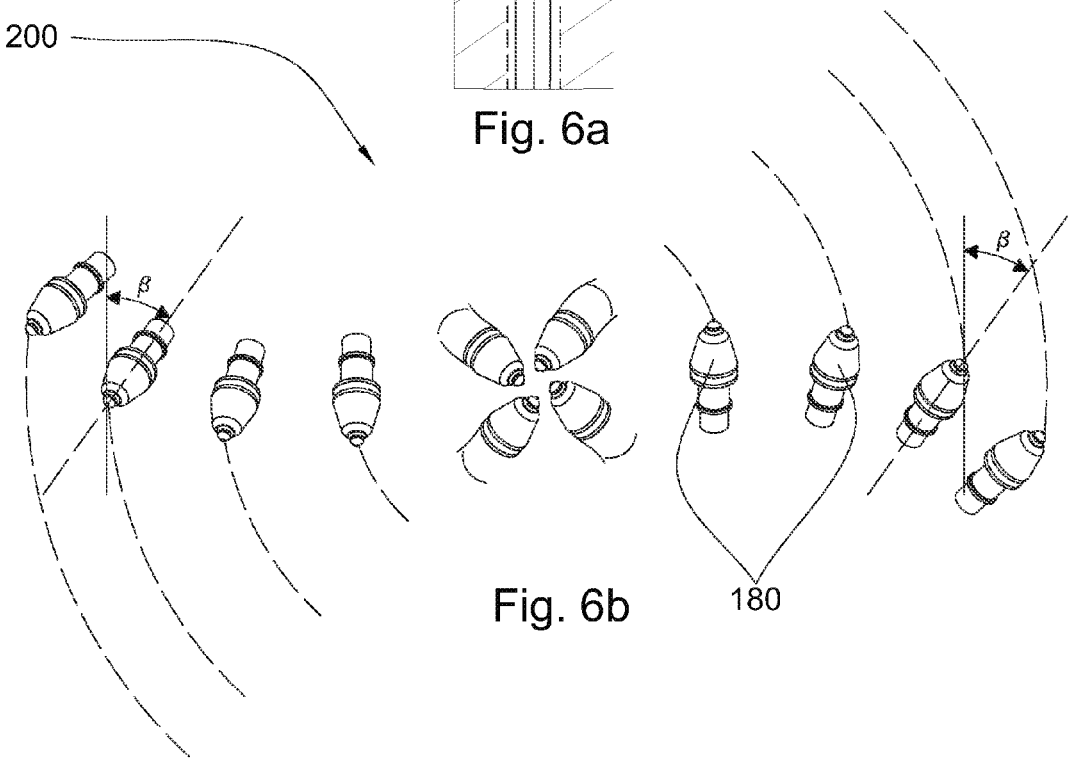

FIG. 6*b* discloses an orthogonal diagram of an embodiment of an auger head assembly 200 comprising a plurality of pointed cutting elements 180. At least one of the pointed cutting elements 180 may comprise measuring mechanism such as strain gauges 600 as shown in FIG. 6*a*. In some embodiments, each cutting element 180 may comprise strain gauges 600 such that each cutting element 180 may be monitored individually. Such an embodiment may provide information about how many cutting elements 180 are working in good condition instantly. Such information may prevent catastrophic failure of the auger head assembly 200 in super hard formations. However, in some embodiments, only selected cutting elements are monitored and the results are inferred to reflect the conditions of the unmonitored cutting elements.

FIG. 7 discloses a cross-sectional diagram of another embodiment of a pointed cutting element 180 comprising strain gauges 600. Strain gauges 600 may be mounted inside the bore hole walls 700 by an adhesive. The cutting element 180 may comprise a single bore hole, thereby reducing the chances of compromising the strength of the cutting element 180. Within the adhesive strip, strain measuring mechanism may be positioned such that at least three orthogonal directions are measured.

FIG. 8 discloses a cross-sectional diagram of another embodiment of a pointed cutting element 180 comprising a button load cell 800. A button load cell 800 is a transducer that is used to convert a force into electrical signal. Such an embodiment may measure axial forces acting on the cutting element 180.

FIG. 9 discloses a cross-sectional diagram of an embodiment of a pointed cutting element 180 mounted on a rotating drum 900 of a milling machine 910. The pointed cutting element 180 may comprise at least one force measuring mechanism such as strain gauges. The forces experienced by the cutting element 180 may be measured by the strain gauges and transmitted to an excavating control mechanism (such as a computer that controls the weight loaded to the drum and the drum's RPM). At least one of the excavating parameters may be modified to align the resultant force 920 with the cutting element's central axis.

FIG. 10 discloses a trenching machine 1000 comprising a plurality of cutting elements 180 on a rotating chain 1010. The present invention may be incorporated into the trenching machine 1000. The rotating chain 1010 rotates in the direction of the arrow 1050 and cuts the formation forming a trench while bringing the formation cuttings out of the trench to a conveyor belt 1030 which directs the cuttings to a side of the trench. The rotating chain 1010 is supported by an arm. Here, the weight on the boom and the speed of the chain may be modified to create an ideal conditions to preserve the pointed cutting elements.

FIG. 11*a* discloses a plurality of pointed cutting elements 180 in a drill bit 1100 that incorporate the present invention. At least one cutting element 180 may comprise at least one measuring means such as strain gauges 600 positioned inside its body as illustrated in FIG. 11*b*.

FIG. 12*a* discloses a plurality of blades 1200 in a drill bit 1100. Each blade 1200 may comprise a plurality of pointed cutting elements 180. At least one blade 1200 may comprise at least one measuring means such as strain gauges 600 positioned in its cross-section. In some embodiments, the strain gauges 600 may be positioned in three different axes of rotation as illustrated in FIG. 12*b*. Such an embodiment may provide adequate information about the forces experienced by the cutting elements 180 without the use of measuring means like strain gauges 600 in each individual cutting element 180.

FIG. 13 discloses a schematic diagram of the method of drilling of the present invention. For instances, both torque and weight loaded to each cutting element may be too high. In such cases, both torque and weight loaded to each cutting element may be decreased to align the resultant force with the cutting element's central axis. In some cases, the depth of cut of the formation may be too high. In such cases, rotational velocity may be increased to align the resultant force with the cutting element's central axis. Also, the weight loaded to each cutting element may be decreased if the rotational velocity is near its maximum limit. In some cases, the depth of cut may be too low. In such cases, the cutting elements may not induce cracks in the formation, thereby making cut ineffective. The weight loaded to each cutting element may be increased to align the resultant force with the cutting element's central axis. Also, the rotational velocity may be decreased if the weight loaded to each cutting element is already near its maximum limit.

In some cases, the resultant force may be too vertical or too horizontal or too offset from the cutting element's central axis. In such cases, the resultant force may be aligned with the cutting element's central axis by modifying at least one excavating parameter as explained in the previous paragraphs. In some cases, a trajectory angle of the cutting element may be too steep, thereby creating too low backstage offset clearance. Thus, sides of the forward end of the cutting element may come in contact with the formation, thereby eroding the sides of the cutting element. In such cases, the weight loaded to each cutting element may be increased to create sufficient backstage offset clearance. The backstage offset clearance may also depend on rate of penetration of the drilling assembly. In some embodiments, the rate of penetration may be decreased to create sufficient backstage offset clearance.

Whereas the present invention has been described in particular relation to the drawings attached hereto, it should be understood that other and further modifications apart from those shown or suggested herein, may be made within the scope and spirit of the present invention.

What is claimed is:

1. A method of excavating with pointed cutting elements, comprising the steps of:

providing an excavating assembly comprising at least one pointed cutting element, the pointed cutting element comprising a rounded apex that intersects a central axis, the pointed cutting element further has a characteristic of having the pointed cutting element's highest impact resistance to resultant forces aligned with the central axis;

engaging the at least one pointed cutting element against a formation such that the formation applies a resultant force against the pointed cutting element;

determining an angle of the resultant force; and modifying at least one excavating parameter to align the resultant force with the pointed cutting element's central axis.

2. The method of claim 1, wherein the excavating assembly comprises at least one transducer.

3. The method of claim 2, further comprising a step of modifying at least one force measured by the at least one transducers to align the resultant force with the pointed cutting element's central axis.

4. The method of claim 1, wherein the at least one excavating parameter is a torque force acting laterally on the cutting element.

5. The method of claim 1, wherein the at least one excavating parameter is weight loaded to each cutting element.

6. The method of claim 1, wherein the at least one pointed cutting element comprises a wear resistant tip comprising a super hard material bonded to a cemented metal carbide.

7. The method of claim 1, further comprising a step of determining an ideal torque, ideal rotational velocity, or ideal weight available to drive the excavating assembly.

8. The method of claim 1, further comprising the step of increasing or decreasing weight loaded to the at least one cutting element to align the resultant force with the central axis of the cutting element.

9. The method of claim 1, further comprising the step of increasing or decreasing rotational velocity to align the resultant force with the central axis of the cutting element.

10. The method of claim 1, further comprising the step of increasing or decreasing torque to align the resultant force with the central axis of the cutting element.

11. The method of claim 1, wherein the excavating assembly is an auger assembly.

12. The method of claim 1, wherein the excavating assembly is a milling machine.

13. The method of claim 1, wherein the excavating assembly is a trenching machine.

14. The method of claim 1, wherein determining the angle of the resultant force comprises the steps of:

providing a plurality of measurement mechanisms positioned inside the cutting elements;

measuring magnitude and direction of the weight loaded to each cutter, and the torque acting on each cutter; and transferring measured data to a excavating control mechanism.

15. The method of claim 14, wherein the measuring mechanisms comprise strain gauges mounted on pre-tensioned strain bolts.

16. The method of claim 14, wherein the measuring mechanisms comprise button load cells.

17. The method of claim 16, wherein the measuring mechanism is adapted to measure along three different orthogonal directions.

18. The method of claim 1, wherein the excavating assembly comprises a drill bit with a plurality of blades, at least one blade comprises a measuring mechanism positioned in the at least one blade's thickness.

* * * * *